US007791630B2

(12) United States Patent
Stolk et al.

(10) Patent No.: US 7,791,630 B2
(45) Date of Patent: Sep. 7, 2010

(54) METHOD OF ADJUSTING AN EXPOSURE DEVICE FOR AN ELECTROPHOTOGRAPHIC PRINTER AND EXPOSURE DEVICE

(75) Inventors: Hendrik J. Stolk, Bergem (NL); Martijn C. H. Van Hoorn, Lent (NL); Lambertus W. Ogink, Venlo (NL); Reinier J. Ramekers, Venray (NL)

(73) Assignee: Oce-Technologies B.V., Venlo (NL)

( * ) Notice: Subject to any disclaimer, the term of this patent is extended or adjusted under 35 U.S.C. 154(b) by 129 days.

(21) Appl. No.: 11/637,156

(22) Filed: Dec. 12, 2006

(65) Prior Publication Data

US 2007/0132833 A1 Jun. 14, 2007

(30) Foreign Application Priority Data

Dec. 13, 2005 (EP) ..... 05112045

(51) Int. Cl.

| | |
|---|---|
| ***B41J 2/385*** | (2006.01) |
| ***B41J 2/435*** | (2006.01) |
| ***B41J 2/45*** | (2006.01) |
| ***B41J 2/47*** | (2006.01) |

(52) U.S. Cl. ..... 347/236; 347/119; 347/130; 347/131; 347/238; 347/240; 347/246; 347/251; 347/253

(58) Field of Classification Search ..... 347/238, 347/253; 399/181

See application file for complete search history.

(56) References Cited

U.S. PATENT DOCUMENTS

| | | | | |
|---|---|---|---|---|
| 5,614,936 | A * | 3/1997 | Takahashi | 347/240 |
| 5,774,165 | A | 6/1998 | Nakajima et al. | |
| 6,498,616 | B1 | 12/2002 | Nagumo et al. | |
| 2003/0128378 | A1 * | 7/2003 | Cooper et al. | 358/1.9 |

FOREIGN PATENT DOCUMENTS

| | | | |
|---|---|---|---|
| EP | 0 850 769 | A2 | 7/1998 |
| JP | 2003-182143 | A | 7/2003 |

* cited by examiner

*Primary Examiner*—Matthew Luu
*Assistant Examiner*—Kendrick X Liu
(74) *Attorney, Agent, or Firm*—Birch, Stewart, Kolasch & Birch, LLP

(57) ABSTRACT

A method of adjusting an exposure device suited for an electrophotographic printer, the exposure device includes a plurality of light-emitting elements. The method includes the steps of energizing selected light-emitting elements according to a selection scheme, using a pre-determined energy level for energizing each selected light-emitting element and obtaining a corresponding exposure intensity distribution from the exposure device. The method further includes the steps of predicting a toner area coverage distribution, based on the obtained exposure intensity distribution and on a pre-established transfer function, obtaining an attribute of the predicted toner area coverage distribution and determining the setting values for the energy levels for energizing each selected light-emitting element such that the obtained attribute becomes a target attribute.

22 Claims, 8 Drawing Sheets

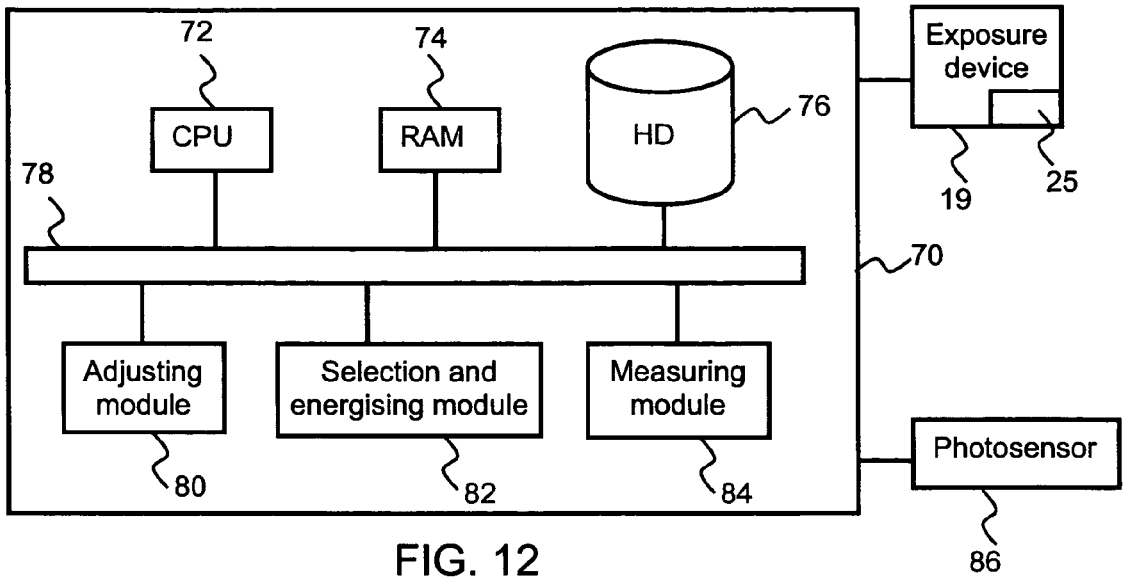
FIG. 12
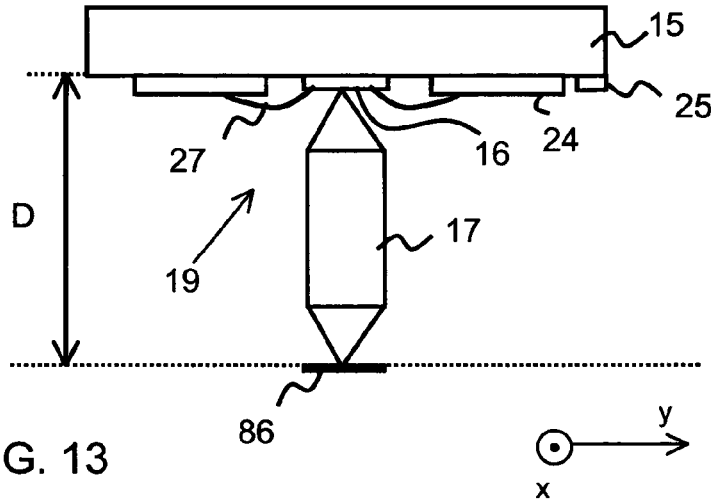
FIG. 13
| LED | ... | 44 | 45 | 46 | 47 | 48 | 49 | 50 | 51 | ... |
|---|---|---|---|---|---|---|---|---|---|---|
| E | ... | $E_1$ | $E_1$ | $E_1$ | $E_1$ | $E_2$ | $E_2$ | $E_2$ | $E_2$ | ... |
FIG. 14

METHOD OF ADJUSTING AN EXPOSURE DEVICE FOR AN ELECTROPHOTOGRAPHIC PRINTER AND EXPOSURE DEVICE

CROSS-REFERENCE TO RELATED APPLICATIONS

This nonprovisional application claims priority under 35 U.S.C. §119(a) on Patent Application No. 05112045.9, filed in the European Patent Office on Dec. 13, 2005, the entirety of which is incorporated herein by reference.

BACKGROUND OF THE INVENTION

1. Field of the Invention

The present invention relates to a method and apparatus for adjusting an exposure device suited for an electrophotographic printer. The present invention also relates to a an exposure device and a printing apparatus that includes the exposure device.

2. Description of Background Art

A category of non-impact printers makes use of an exposure device such as a printhead. A plurality of light-emitting elements record latent images on a photosensitive an exposure device may be provided with an array of light-emitting elements such as light emitting diodes (LEDs). A lens mechanism such as a rod lens array (commercially available under the trade-marked name SELFOC) can be used in the printhead for focussing the light emitted by the LEDs on the photosensitive recording member. Printers of the above mentioned type also include a developer that develops the latent image formed on the photosensitive member into a visual toner powder image. Such printers further include a transfer mechanism that transfers the toner powder image from the photosensitive recording member onto an image receiving medium such as a sheet of paper.

In exposure devices of the above mentioned type, the LEDs are mounted on a solid substrate and generally arranged in rows across the width of the photosensitive recording member. LED chips may be provided, each one of the chips containing for example a block of 128 integrated LEDs. A number of LED chips can be mounted on a module plate and several module plates can be mounted such that a print bar of a desired width is formed whereon LEDs are spaced with a constant pitch.

Energy output levels are applied to the LEDs by associated drivers, in order to produce light spots on the photosensitive receiving member for producing an image made of picture elements (pixels). Spots having multiple energy levels are obtained by providing multiple levels of output power for a constant period of time, or by providing a constant output power level for a period of time proportional to the gradation value of a pixel. In so-called binary printers, only two possible energy levels can be applied to an LED, one level for giving rise to a light spot, the other level being a zero energy level. If a charge area development process is used, a light spot projected on the photosensitive member with a light intensity larger than a so-called print threshold intensity is discharging locally the photosensitive material and no toner is developed locally (no pixel). If a charged area development is used and an LED is not driven (zero-energy level), the photosensitive member remains locally charged and toner is locally transferred for giving rise to a pixel. Although the present invention is described for a charged area development type of process, the present invention is also suitable for an uncharged area development type of process, making the required changes.

The unevenness of the optical density in printed images obtained with printers using such an exposure device that includes LEDs has to be minimized. Unevenness of the optical density in printed images may be caused by a large spread of the light intensities emitted by the LEDs due to a production process or material, temperature dependence of the LED output yield and differing light transparency of the lens mechanism (for example, a Selfoc lens array) across the print width. Another source for the unevenness of the optical density in printed images are local imperfections of the rod lens array, such as anomalous lens rod fibers or misaligned lens rod fibers. Unevenness of the optical density in printed images can also be caused by height differences of LEDs, or of LED-chips or of chip module plates. In order to minimize the unevenness of the optical density in printed images, setting values for the energy output level for driving each light-emitting element are determined, before the exposure device is mounted in the printing apparatus.

A method of the above type is known from U.S. Pat. No. 5,774,165. With the known method, although the light intensity distribution of each LED has substantially the same predetermined width at a predetermined light emission intensity, printed images still present unevenness of the printed optical density.

SUMMARY OF THE INVENTION

It is an object of the present invention to provide a method and apparatus for adjusting an exposure device suited for an electrophotographic printer by which the unevenness of the optical density in printed images in strongly reduced.

In accordance with an embodiment of the method of the present invention, this object is accomplished by a method of adjusting an exposure device suited for an electrophotographic printer, said exposure device comprising a plurality of light-emitting elements, said method comprising the steps of: energizing selected light-emitting elements according to a selection scheme; using a pre-determined energy level for energizing each selected light-emitting element; obtaining a corresponding exposure intensity distribution from the exposure device; predicting a toner area coverage distribution, based on the obtained exposure intensity distribution and on a pre-established transfer function; and obtaining an attribute of the predicted toner area coverage distribution and determining setting values for the energy levels for energizing each selected light-emitting element such that the obtained attribute becomes a target attribute.

Adjusting an exposure device for an electrophotographic printing apparatus thus achieves more reliable setting values for the energy levels for energizing each light-emitting element. In particular, the images printed by a printing apparatus using an exposure device adjusted according to the method of the present invention present a high degree of evenness of the optical density. Since an attribute of the predicted toner area coverage distribution is obtained, which is related to the process used in the printing apparatus for which the adjustment of the exposure device is performed, the obtained setting values are reliable. In particular, the setting values do not solely depend on an obtained exposure intensity distribution. The setting values also depend on attributes of the predicted toner area coverage distribution.

In one embodiment of the method according to the present invention, the obtained attribute of the predicted toner area coverage distribution is a locally averaged value of the predicted toner area coverage distribution. This contributes to obtain setting values for the energy levels for energizing each light-emitting element that enable an enhanced evenness of the printed optical density.

In another embodiment of the method according to the invention, the pre-established transfer function represents a typical variation of the toner area coverage obtained on a print medium as a function of the received light intensity for the type of process used by the printing apparatus for which the adjustment is performed. The pre-established transfer function is, from a statistical point of view, a very suitable function for representing the properties of the type of process used by the printing apparatus for which the adjustment is performed. The optical density in printed images presents an excellent evenness. In particular, the banding effects, which are undesirable, are strongly reduced.

In accordance with an embodiment of the apparatus of the present invention, the above object is accomplished by an apparatus for adjusting an exposure device suited for an electrophotographic printer, said exposure device comprising a plurality of light-emitting elements, said apparatus comprising a selection and energizing module that energizes selected light-emitting elements according to a selection scheme, using a pre-determined energy level for energizing each selected light-emitting element; a measuring module that obtains a corresponding exposure intensity distribution from the exposure device; an adjusting module that predicts a toner area coverage distribution, based on the obtained exposure intensity distribution and on a pre-established transfer function, to obtain an attribute of the predicted toner area coverage distribution and to determine setting values for the energy levels to energize each selected light-emitting element such that the obtained attribute becomes a target attribute. The apparatus thus enables the method of the present invention to be executed automatically.

The object of the present invention can also be accomplished by an exposure device comprising a plurality of light-emitting elements for forming images in an electrophotographic printing apparatus; driver means for individually applying energy output levels to the light-emitting elements; a lens mechanism that focuses the light emitted by the light-emitting elements, a storage device that stores a list comprising setting values for said energy output levels, said list consisting of a plurality of setting values obtained by the method of the present invention.

The object of the present invention can also be accomplished by a printing apparatus comprising the exposure device of the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 12 diagrammatically illustrates an apparatus for setting the values for the energy output levels for driving the LEDs of an exposure device;

FIG. 13 diagrammatically illustrates the arrangement of an exposure device during the measurements of the exposure intensity distribution; and FIG. 14 is an example of a portion of a look-up table comprising the setting values for the energy output level for driving each individual LED.

DETAILED DESCRIPTION OF THE PREFERRED EMBODIMENTS

Figure 1:
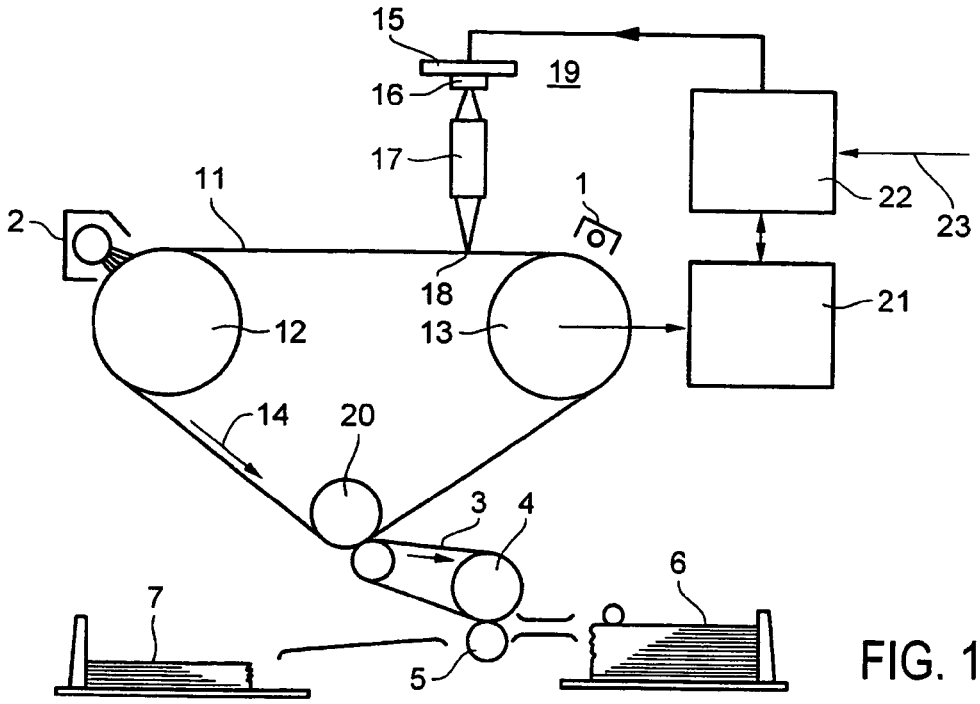
FIG. 1 diagrammatically illustrates a printer using an exposure device with a linear array of LEDs.

FIG. 1 is a diagrammatic illustration of a printer in which an electrophotographic belt 11 is passed about three rollers 12, 13 and 20 in the direction of arrow 14. A belt of this kind, for example, provided with a zinc oxide layer or an organic photosensitive layer, is charged in a known manner by means of a charging unit 1 and then exposed image-wise by an exposure device 19. The places of the belt 11 which have not received light are developed with toner powder by means of a developing device 2. The resulting powder image is transferred in a known manner to a heated silicone rubber belt 3. A sheet of receiving material is passed from a sheet tray 6 between rollers 4 and 5, and the powder image is transferred from the silicone rubber belt 3 to the receiving sheet on which it is fused. The resulting print is deposited in a collecting tray 7. The exposure device 19 comprises a rod lens array 17 and a carrier 15 with a row of LEDs 16 extending perpendicularly to the direction of advance of the belt 11 and mounted above the belt 11. An array of imaging glass fibers (rod lens array) 17 is mounted between the LEDs 16 and the belt 11 and images each spot light emitted by an LED with an imaging ratio 1:1 on the electrophotographic belt 11 (point 18). An image signal is fed via line 23 to an energizing device 22. A pulse disc is disposed on the shaft of roller 13 and delivers a signal in proportion to the movement of belt 11. This signal is fed to a synchronisation device 21 in which a synchronisation signal is generated. The image signals are fed to the exposure device 19 in response to the synchronisation signal so that the electrophotographic belt 11 is exposed line by line image-wise, so that a row of image dots is formed on the belt 11.

Figure 2:
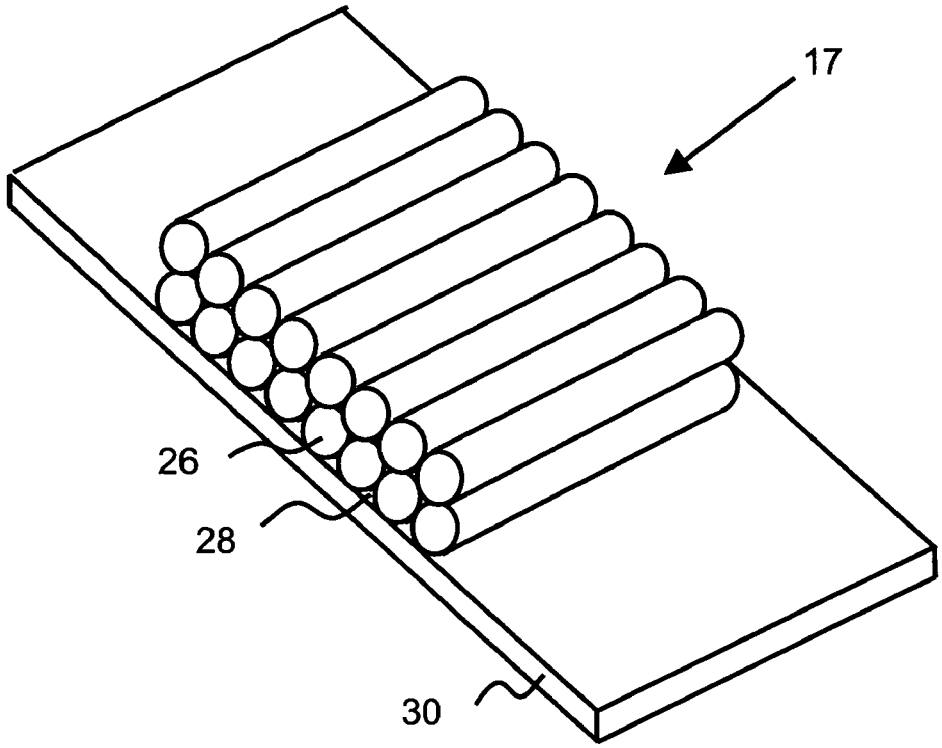
FIG. 2 diagrammatically illustrates a rod lens array of an exposure device.
Figure 3:
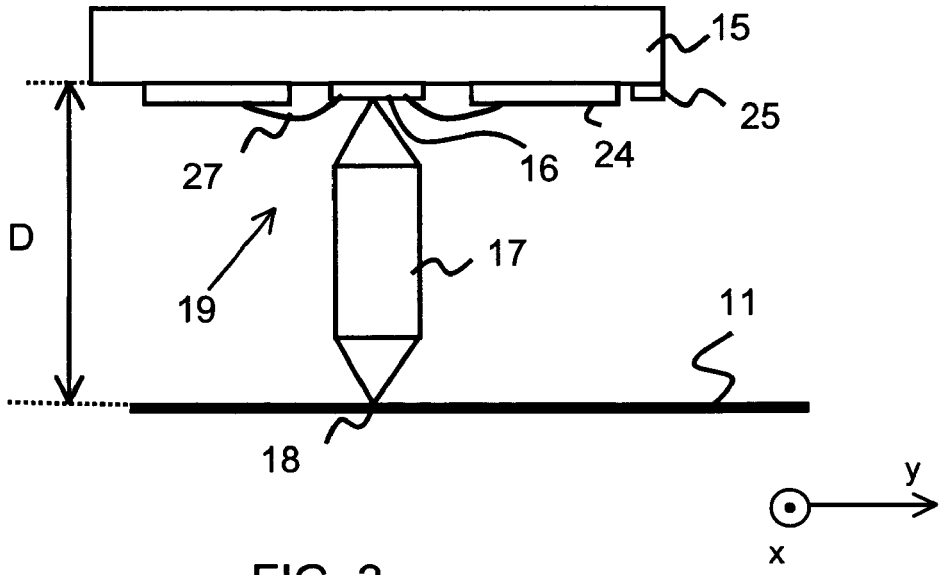
FIG. 3 diagrammatically illustrates an exposure device having a linear array of LEDs and a rod lens array.

FIG. 2 is a diagrammatic illustration of a rod lens array 17, such as a Selfoc lens array, used in exposure device 19 such as the one shown in FIG. 3 for imaging the light emitted by the LEDs on the electrophotographic belt. Individual graded index optical fibers 26 are bounded into an array, for example in a two lines configuration. An adhesive member 28 such as an opaque resin may be used to fill the gaps between individual glass fibers 26 to make them hold together. To strengthen the structure, the array of optical fibers may be pinched by two side plates 30 of which only one is shown in the drawing.

FIG. 3 is a diagrammatic illustration of an exposure device 19 comprising a substrate 15 on which a number of LED chips with LEDs 16 and LED drivers 24 is disposed, and a rod lens array 17. A single LED chip may be provided with a large number of LEDs, for example 128 or 192. The exposure device may comprise 40 to 60 LED chips, on which the LEDs are positioned regularly. The LED chips are positioned on the substrate 15 in such a way that a row 32 (see FIG. 5A) of individually operable light sources with a constant LED pitch is formed, the LED pitch being for example 42.3 μm for an exposure device with a line resolution of 600 dpi. The total number of LEDs in the exposure device is N and the LEDs are individually numbered from 1 to N. Each one of the drivers 24 operates an associated LED with an adjustable current, which is fed via the conductor 27. The drivers may be positioned in one row. The drivers may also be positioned in two rows, as is shown in FIG. 3, the drivers in one row operating the LEDs with an even number, the drivers in the other row operating the LEDs with an uneven number. The energy output level delivered by each driver is adjustable for each individual LED. A non-volatile memory 25 is provided for storing a list (Look-up table or LUT) comprising the setting values for the energy output level for driving each individual LED. The rod lens array 17 is used to focus the light emitted by the LEDs 16 on the photosensitive recording member 11. The exposure device 19 is mounted at a certain position in the printing apparatus. The distance D between the exposure device 19 and the surface of the photosensitive recording member 11 is indicated in FIG. 3. D is defined as the shortest distance between the substrate surface on which the LED chips are mounted and the surface of the photosensitive member on which the light is projected (or is to be projected). D thus defines the position of the focus plane, in which the photosensitive member is ideally located. The photoconductor 11 is exposed line by line image-wise, so that a row of images dots 18 is formed on the belt.

The method for determining the setting values for the energy output levels for driving the LEDs according to the invention is usually performed before the exposure device is mounted in a printing apparatus. The method is performed upon taking into account the conditions in which the exposure device is to be submitted once mounted in the printing apparatus. In particular, when an exposure intensity distribution is measured, the measurement is performed at a same distance D from the exposure device. This is in order to measure an exposure distribution comparable to the one that is to be obtained on the belt 11 once the exposure device is mounted in the printing apparatus of FIG. 1. Therefore, measurements of exposure intensity distributions as described hereinafter may be achieved using a photosensor 86 placed at a distance D from the exposure device 19, as is shown in FIG. 13.

Figure 5A:
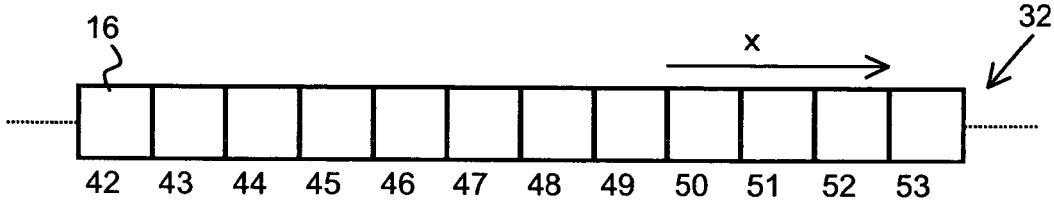
FIG. 5A schematically illustrates the arrangement of LEDs in an exposure device.
Figure 4:
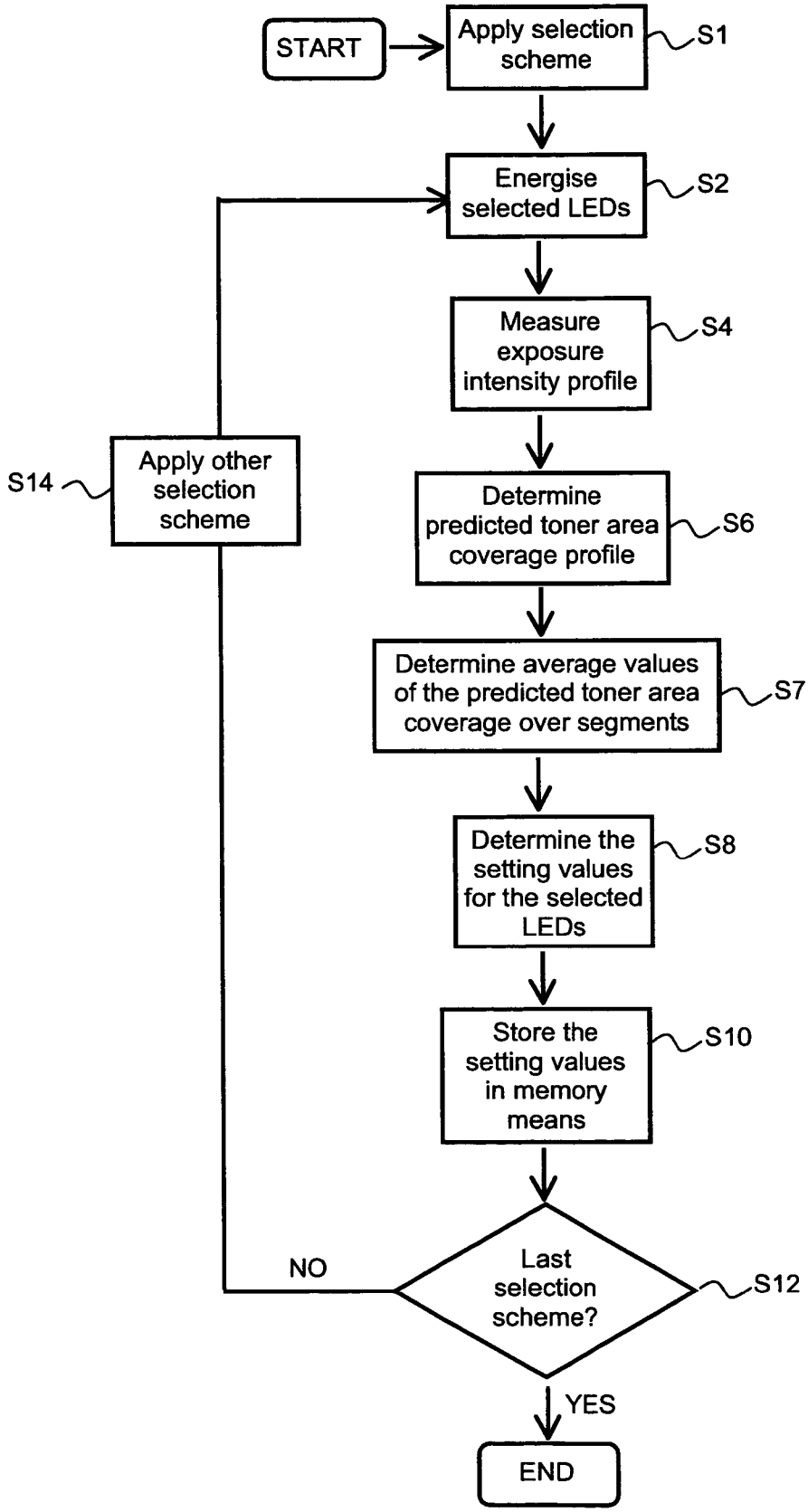
FIG. 4 is a flow diagram of the method according to an embodiment of the present invention.

FIG. 4 is a flow diagram of the method according to a first embodiment of the invention. In step S1, a first selection scheme is applied to the LEDs of the exposure device 19 comprising a row 32 of LEDs 16. The concept of 'selection scheme' is explained with reference to FIGS. 5A, 5B and 5C. FIG. 5A represents schematically a planar view of a portion of the row 32 of LEDs, wherein each square represents the position of an individual LED 16. The LEDs are individually numbered, as is indicated below each LED 16 by an index, which also gives the position of the LED in a direction x extending parallel to the row 32. According to a first selection scheme for energizing the LEDs shown in FIG. 5B, each LED within a first group 33 of four LEDs is selected, while all LEDs in the neighboring group 34 of four LEDs remain unselected. This selection pattern is repeated regularly over the whole length of the array, that is, for the N LEDs of the row 32. Another selection scheme is defined and is represented in FIG. 5C. Other selection schemes could be defined. Each LED of the row 32 should be selected at least once in any of the selection schemes. Since the schemes of FIGS. 5B and 5C are complementary of each other, it happens to be the case that each LED of the row 32 is selected at least once in the scheme of FIG. 5B or in the scheme of FIG. 5C.

Figure 5B:
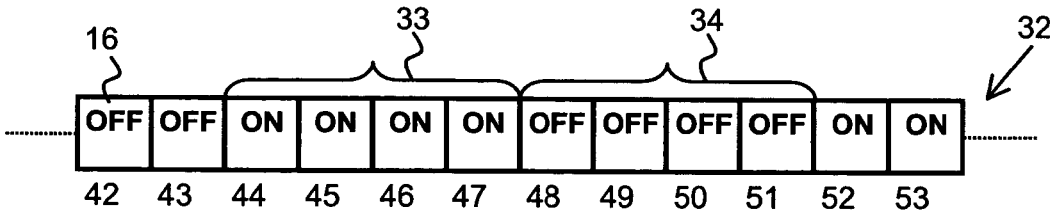
FIG. 5B illustrates a selection scheme for energizing the LEDs of the exposure device.
Figure 5C:
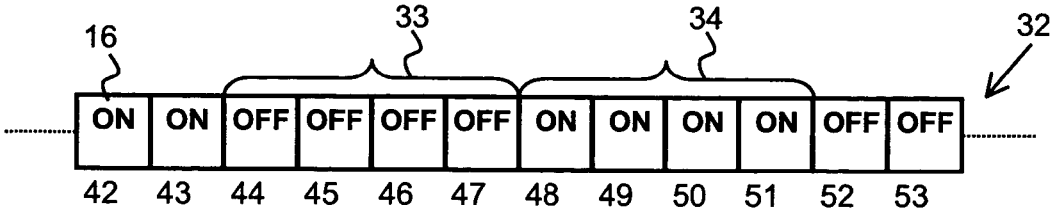
FIG. 5C illustrates another selection scheme for energizing the LEDs of the exposure device.

In step S2, the LEDs of the exposure device 19 are energized according to the selection scheme of FIG. 5B, using a same pre-determined energy level for driving each of the energized LEDs. Each of the LEDs (44, 45, 46, 47, etc) which is energized in step S2 is driven such that each of the corresponding driver 24 outputs a same pre-determined energy output level $E_0$. The energy output level at which an LED is driven may be characterized by the value of the output current delivered by the associated driver. The light emitted by the energized LEDs is transmitted by the rod lens array 17 which focuses the light in a plane located at the distance D from the LEDs. A resulting exposure intensity distribution is obtained.

Figure 6A:
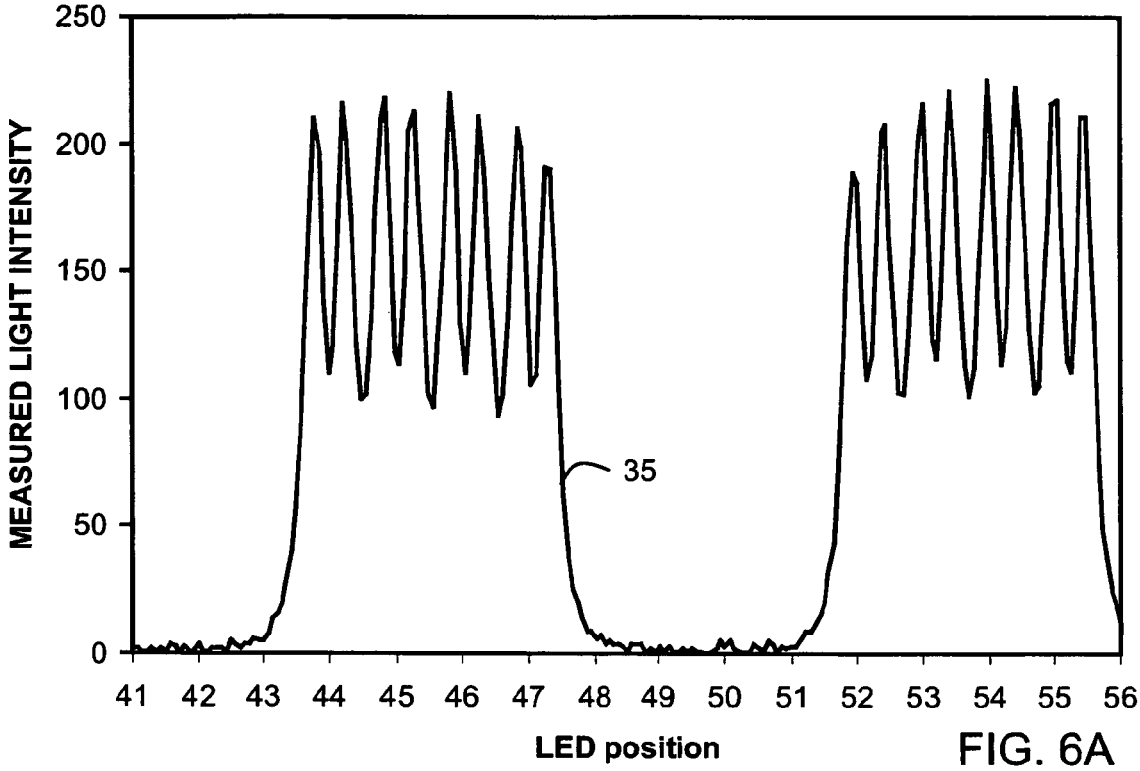
FIG. 6A is a graphical representation of the measured 1 D exposure intensity distribution of an exposure device having a row of LEDs energized according to a selection scheme.

In step S4, while the selected LEDs are driven according to the scheme shown in FIG. 5B, the resulting exposure intensity distribution is measured. For performing the measurement of the exposure intensity distribution, the photosensor 86, which is mounted on a motor-driven guide block, is moved across the print width, i.e. across the length of the row 32 along the direction x. During the displacement of the photosensor, the shortest distance between the measuring surface of photosensor and the exposure device 19 remains substantially equal to the distance D. D is the distance between the exposure device 19 and the surface of the photosensitive recording member 11 as indicated in FIG. 3, when the exposure device is mounted in the printing device. Thus, the light intensity distribution is measured at a distance D from the LEDs that would be the distance to the photosensitive member if the exposure device was mounted in the printing apparatus of FIG. 1. The light intensity distribution is measured in the direction x which would be perpendicular to the transport direction of the photosensitive belt if the exposure device was mounted in the printing apparatus of FIG. 1. An example of a measured exposure intensity distribution is shown in FIG. 6A, which is a graphical representation of the measured light intensity as a function of the position of the photosensor in the x-direction. Since the LEDs are energized according to the selection scheme shown in FIG. 5B, the measured intensity distribution 35 presents dips considered in the x-direction at places corresponding to the position of the non-energized LEDs (for example, LEDs with index 48, 49, 50, 51) and peaks at places corresponding to the position of the energized LEDs (for example, LEDs with index 44, 45, 46, 47).

If the exposure device was placed in an operating printer of the type shown in FIG. 1, and driven according to the scheme presented in FIG. 5B, it would give rise to a band-like latent image on the photosensitive belt 11. A band-like toner powder image would be developed on the belt 11 by means of the developing device 2. The resulting powder image would be transferred to the silicone rubber belt 3. Finally, the powder image would be transferred from the silicone rubber belt 3 to a receiving medium such as a sheet of paper. A band-like toner powder image would thus be obtained on said receiving medium. Though the exposure device is not actually placed in a printer, based on the measured exposure intensity distribution 35 as shown in FIG. 6A, a toner area coverage distribution on the medium can be predicted. The predicted toner area coverage corresponds to the amount of toner that would be developed on a receiving medium, for example, a sheet of paper, if the exposure device was in operation in a printer.

Figure 6B:
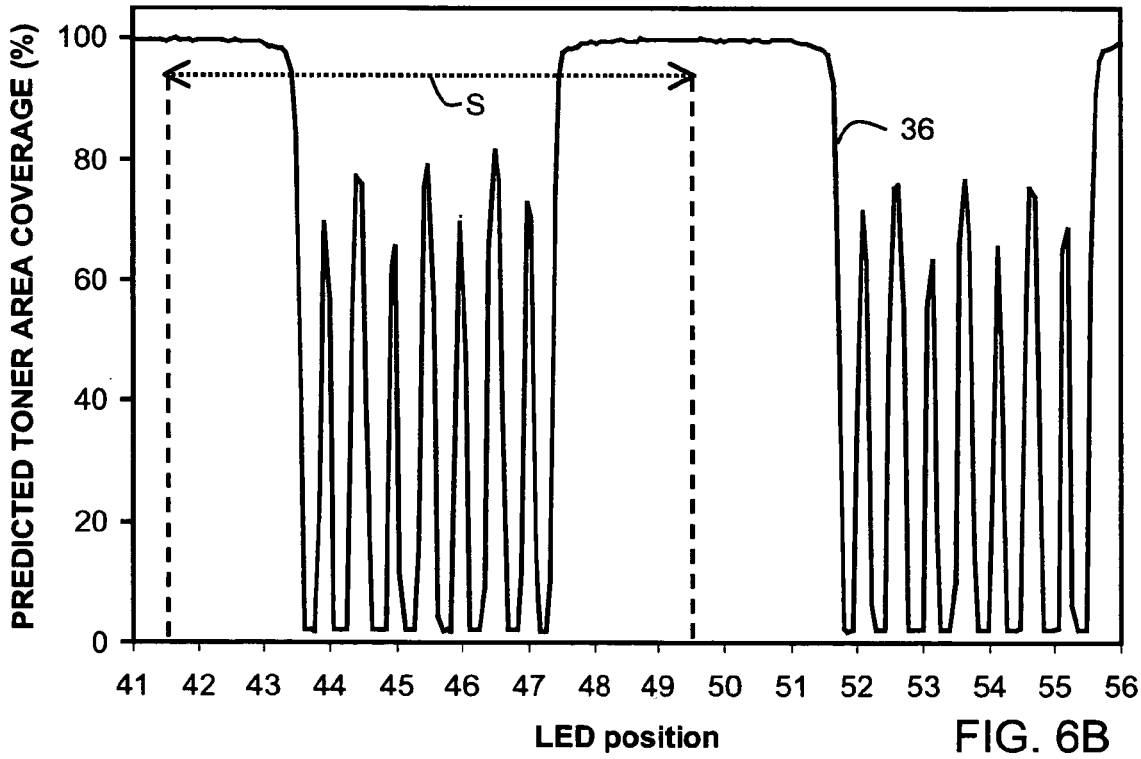
FIG. 6B is a graphical representation of the predicted toner area coverage distribution, based on the measured exposure intensity distribution as shown in FIG. 6A.

In step S6, the predicted toner area coverage distribution is determined, based on the measured exposure intensity distribution. The predicted toner area coverage distribution varies in the x-direction as shown in FIG. 6B by the curve 36. With the process as described above (charge area development process), the places of the belt 11 which would have not received light would be developed with toner powder. Therefore, at the x-positions where the exposure intensity distribution 35 presents peaks, the predicted toner area coverage is low (x-position with index 44, 45, 46, 47), while at the places where the light distribution 35 presents dips, the predicted toner area coverage is high (x-positions 48, 49, 50, 51).

Figure 7:
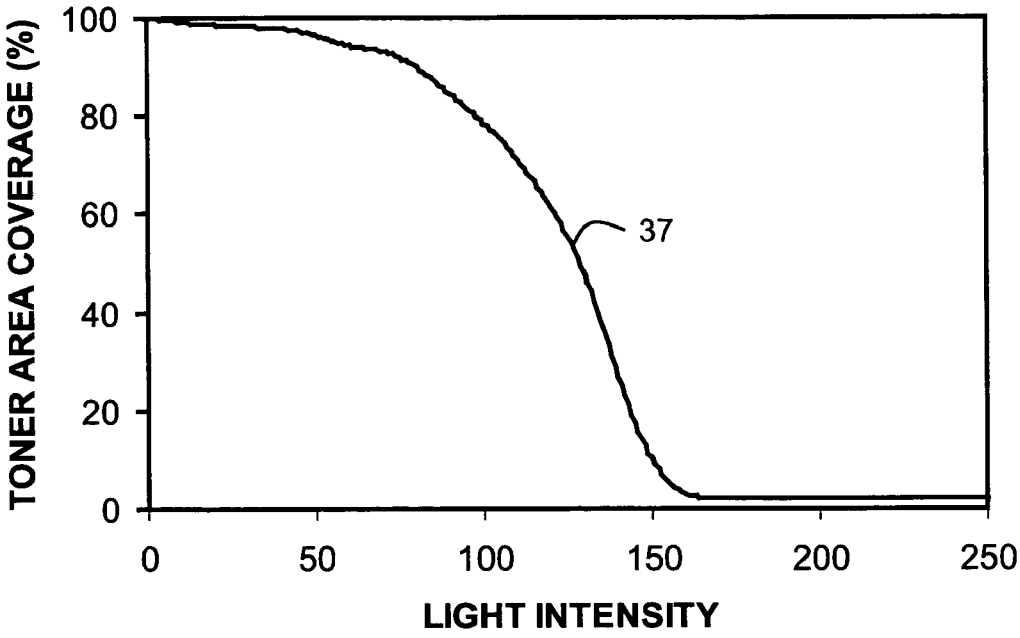
FIG. 7 is a graphical representation of the transfer function used for predicting the toner area coverage as a function of the measured exposure intensity.

For the determination of the predicted toner area coverage distribution in step S6, a transfer function such as the one shown in FIG. 7 is used. The transfer function 37 shown in FIG. 7 is an example of a pre-determined representative function which permits predicting the toner area coverage distribution according to an exposure distribution when a selection scheme for energizing light-emitting elements is used. The transfer function characterizes the typical variation of the toner area coverage obtained on a print medium as a function of the received light intensity for the type of printer for which the adjustment of the exposure device is done. It is characteristic of the type of process used by the printing apparatus for which the adjustment is performed. The function is obtained experimentally by measuring a large number of times the toner area coverage response of the printing apparatus as a function of the measured light intensity, such that the result is a statistically good representative of the type of process used by the printing apparatus for which the adjustment is performed. A toner area coverage sensor may be used for the measurements of the toner area coverage on the print medium. Alternatively, it is possible to make use of a scanner for determining the toner area coverage, using the knowledge of the relationship between the measured signal such as lightness and the toner area coverage developed on the print medium. The toner area coverage is directly linked to the optical density of the toner on the printed medium. The transfer function in FIG. 7 is normalized to 100%. A toner area coverage value of 100% thus indicates the maximum possible optical density on the print medium.

In step S8, the setting values for the energy output levels for driving the selected LEDs are determined for the light-emitting elements energized according to the scheme shown in FIG. 5B. The settings values for the energy levels for energizing each selected light-emitting element are determined such that an obtained attribute becomes a target attribute. The determination of the setting values for the energy output levels for driving the selected LEDs is based on the predicted toner area coverage distribution.

An example of determination of the setting values for the energy output levels for driving the selected light-emitting elements is now given. The determination may be performed for a group comprising a number of LEDs. It is now explained how to determine the setting values for the energy output levels driving the LEDs having indexes 44, 45, 46 and 47. The description is easily transferable to any other group of LEDs.

Considering again the selection scheme of FIG. 5B, in the present example, each one of the LEDs indexed 44, 45, 46 and 47 was energized in step S2 at a value $E_0$ of energy level. The neighboring LEDs (with indexes 42, 43, 48 and 49) were not energized. Since the light intensity distribution has been measured in step S4 and the predicted toner area coverage distribution has been predicted in step S6, it is now possible to predict what would be the averaged toner area coverage along a segment S that extends from the x-positions 42 to 49 and which corresponds to eight LED positions. For this, in step S7, an average of the predicted toner area coverage is determined by averaging the toner area coverage values represented in FIG. 6B along the segment S. The average value of the predicted toner area coverage is noted $T_1$.

Figure 8:
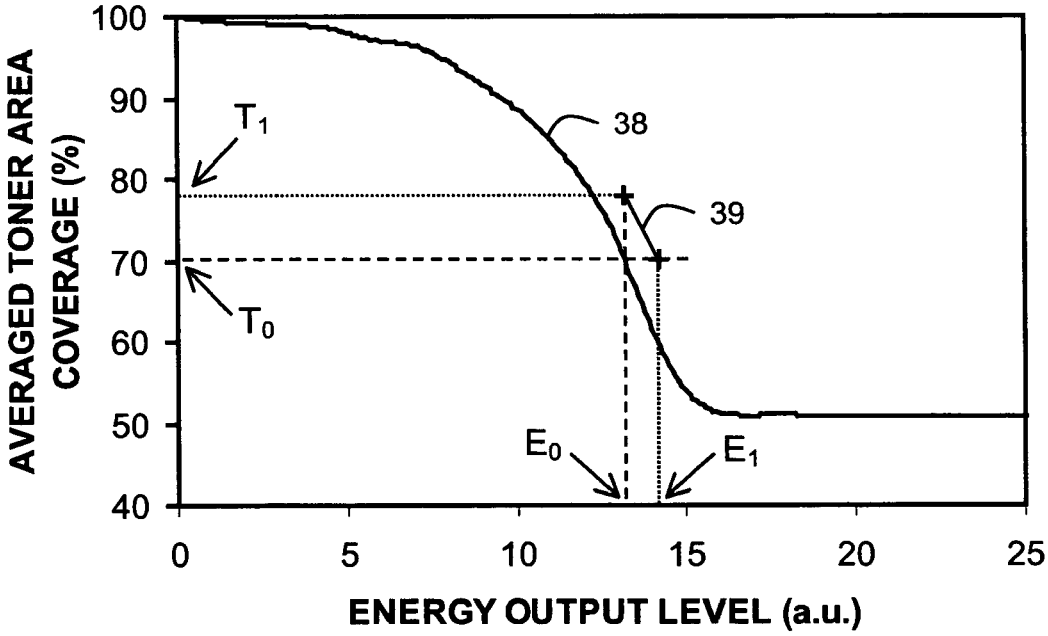
FIG. 8 is a graphical representation of a representative function giving the expected averaged toner area coverage as a function of the energy output level applied to LEDs when the LEDs are energized according to a selection scheme.

In FIG. 8, a curve 38 is shown which is a representative of the averaged toner area predicted for an illumination scheme as shown in FIG. 5B, as a function of the energy output level E used for energizing the selected LEDs. Since only half of the LEDs is energized according to the selection scheme, at high energy levels, the averaged toner area coverage tends to reach the level 50%. The curve 38 of FIG. 8 is based on the pre-established transfer function 37 (see FIG. 7) representative of the toner area coverage as a function of the exposure intensity and on the knowledge of the variation of the light intensity as a function of the energy level. Experimentally, it has been noticed that a good approximation of the variation of the light intensity as a function of the energy output level for driving an LED is a linear function.

Ideally, when four LEDs are energized at a value $E_0$ for the energy output level in accordance with the selection scheme of FIG. 5B, the average of the predicted toner area coverage over the segment S should be equal to $T_0$. This is illustrated in FIG. 8 by a horizontal dashed line. However, as has been determined from the measurements shown in FIG. 6B, the average of the predicted toner area coverage over said segment S takes the value $T_1$. The value $T_1$ is illustrated in FIG. 8 by a horizontal dotted line. The value $T_1$ is, compared to the target value $T_0$, too large. Therefore, the value $E_0$ of the energy output level at which the group of LEDs 44, 45, 46 and 47 is driven while measuring the intensity distribution, is too low and needs to be modified such that a modified value $E_1$ for the energy output level is obtained. Once determined, $E_1$ is thus the setting value for the energy output level for driving the LEDs with indexes 44, 45, 46 and 47. For these LEDs, $E_0$ must be corrected in such a way that the target $T_0$ for the averaged predicted toner area coverage is reached. For achieving this goal, the curve 38 shown in FIG. 8 may be used. As is shown in FIG. 8, for a value $E_0$ of the energy output level, a toner area coverage having the target value $T_0$ is expected. However, for the group of LEDs with indexes 44, 45, 46 and 47, an averaged toner area coverage having the value $T_1$ is predicted. This indicates that the averaged response of the predicted toner area coverage at the x-positions 44, 45, 46 and 47 somewhat differs from the representative function 38. The setting value $E_1$ for the energy output level for driving the LEDs with indexes 44, 45, 46 and 47 may be obtained by the following relationship:

$$E_1 = E_0 + \frac{(T_0 - T_1)}{\left(\frac{dT}{dE}\right)_{LOCAL}}$$

whereby $$\left(\frac{dT}{dE}\right)_{LOCAL}$$

is the local value of the derivative of the transfer function at the local point (i.e. between $T_0$ and $T_1$), taking a negative value in the present example since the transfer function is a decreasing function of the light intensity.

$$\left(\frac{dT}{dE}\right)_{LOCAL}$$

is equal to the local slope of the curve 38 and is represented in FIG. 8 by the portion 39. It is used for determining the setting value $E_1$, as represented in FIG. 8.

Step S8 is performed such that the setting values for the energy output level for driving the LEDs that were energized according to the first scheme of FIG. 5B are determined. Thus, similarly to what has been explained for the group of LEDs with indexes 44, 45, 46 and 47, a setting value for the energy output level for driving the LEDs is obtained for each other group of four energized LEDs.

In step S10, the values of the setting values for the energy output levels for driving the LEDs are transmitted to the non-volatile memory 25 suited for storing the list (Look-up table or LUT) comprising the setting values for the energy output level for driving each individual LED. The look-up table thus gives, for each of the selected LED, an adjusted energy output level for the corresponding driver, which may be the current value at which the LED has to be driven in operation. According to the example detailed above, the look-up table thus indicates that the setting value $E_1$ for the energy output level to has to be used to drive individually each one of the LEDs with indexes 44, 45, 46 and 47.

In step S12, it is checked whether the selection scheme that has been applied to the LEDs was the last. After the setting values have been determined for the LEDs selected according to the selection scheme of FIG. 5B, another selection scheme has to be applied. Therefore, the scheme according to FIG. 5C is applied in step S14. The steps S2 to S10 are repeated for the LEDs selected according to this complementary scheme. After step S8, setting values for the energy output levels for driving the selected LEDs are available. Since the selection scheme of FIG. 5C has been applied, in similarity with the approach explained above, it means that, for example, a setting value $E_2$ for the energy output level for driving the LEDs with indexes 48, 49, 50 and 51 is determined.

In step S10, the setting values for the energy output levels for driving the LEDs are passed to the exposure device exposure device 19 for the purpose of storing them in the form of a the look-up table in the non-volatile memory 25. Now that each one of the N LEDs of the exposure device has been selected, the method for adjusting the exposure device is terminated. The look-up table is complete, and provides setting values E for the energy output level for driving each individual LED. A portion of the look-up table (LUT) is illustrated in FIG. 14, summarizing the results obtained for the LEDs with indexes 42 to 51. Of course, in reality, the LUT comprises the setting values for the energy output level to be applied to each of the N LEDs of the exposure device.

In the embodiment above, each LED of a group of four LEDs is attributed the same setting value such as $E_1$ or $E_2$. It is however also possible to obtain a different adjusted energy level for each LED by means of a function fitting the determined setting values for the energy output level as a function of the index of the LEDs. Alternately, it is also possible to apply different selection schemes to the row of LEDs, in such a way that an individual LED is selected more than once for being energized. Although this increases the number of measurements required, it provides a means for increasing the accuracy of the method.

Figure 9:
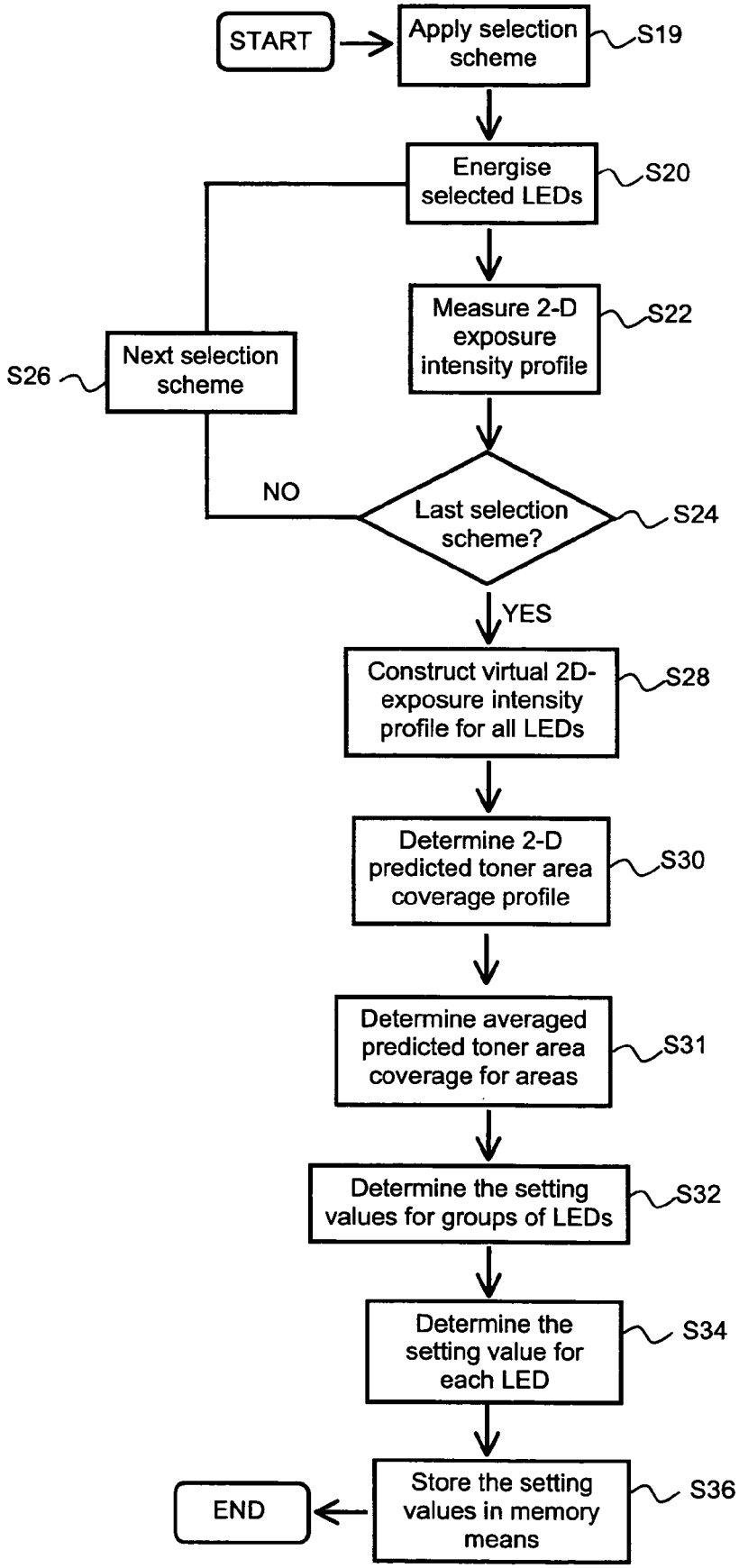
FIG. 9 a flow diagram of the method according to another embodiment of the present invention.

In a second embodiment of the method according to the present invention, a virtual two-dimensional exposure intensity distribution for all LEDs is constructed. FIG. 9 is a flow diagram of the method according to the second embodiment of the invention. In step S19, a selection scheme such as the scheme shown in FIG. 5B is applied to the LEDs of row 32. In step S20, the selected LEDs are energized, using for this purpose a same pre-determined energy level $E_0$. The resulting two-dimensional exposure intensity distribution is measured in step S22, by means of a photosensor 86 placed at a distance D, according to an arrangement such as shown in FIG. 13. Such an exposure intensity distribution resembles to the one shown in FIG. 6A, with the difference that a light intensity component is also measured in a direction y perpendicular to the x-direction. The y-direction is actually substantially parallel to the displacement direction of the photosensitive member 11 in the printing apparatus as shown in FIG. 1. No special measure is required for measuring such distribution, as long as the photosensor used for the measurement is able to measure a quantity of light in the y direction over a limited range at least equal to the dimension of a formed light spot 18. In step S24, it is checked whether the selection applied was the last. A next selection scheme, such as the one shown in FIG. 5C is thus applied in step S26. Steps S20 and S22 are repeated with the other selection scheme.

Figure 10:
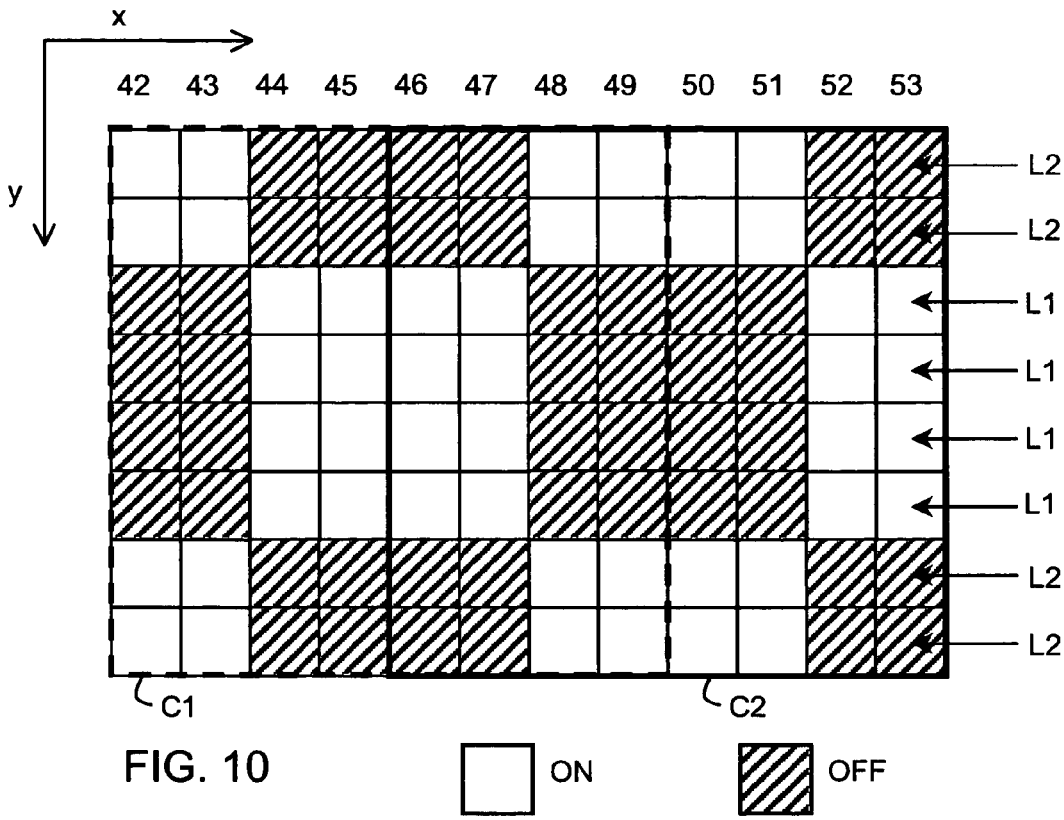
FIG. 10 schematically illustrates a virtual 2D energizing pattern for a number of LEDs.

Two two-dimensional exposure intensity distributions have thus been measured and stored (S22). In step S28, a virtual two-dimensional exposure intensity distribution is constructed. The virtual distribution is to be understood as the variation of light that the surface of the photosensitive belt 11 would receive in operation in the printer of FIG. 1, if the LEDs were energized alternately according to the scheme of FIG. 5B and to the scheme of FIG. 5C. The way of obtaining such a virtual distribution is illustrated in FIG. 10. A non-filled square represents a position in an x-y plane where light would be received, since the corresponding LED would be turned on. On the other hand, a filled square represents a position in an x-y plane where no light would be received, since the corresponding LED would be turned off. A number of lines L1 are shown, each line corresponding to the selection scheme of FIG. 5B. On the other hand, each of the lines L2 corresponds to the selection scheme of FIG. 5C. The lines L1 and L2 are repeated according to the pattern of FIG. 10 in order to construct a virtual two-dimensional light image. In said virtual light image, each one of the N LEDs is energized once. For example, LEDs with indexes 42, 43, 48, 49, 50, 51 etc. are energized along the lines L2, while the LEDs with indexes 44, 45, 46, 47, 52, 53 etc. are energized along the lines L1.

Figure 11:
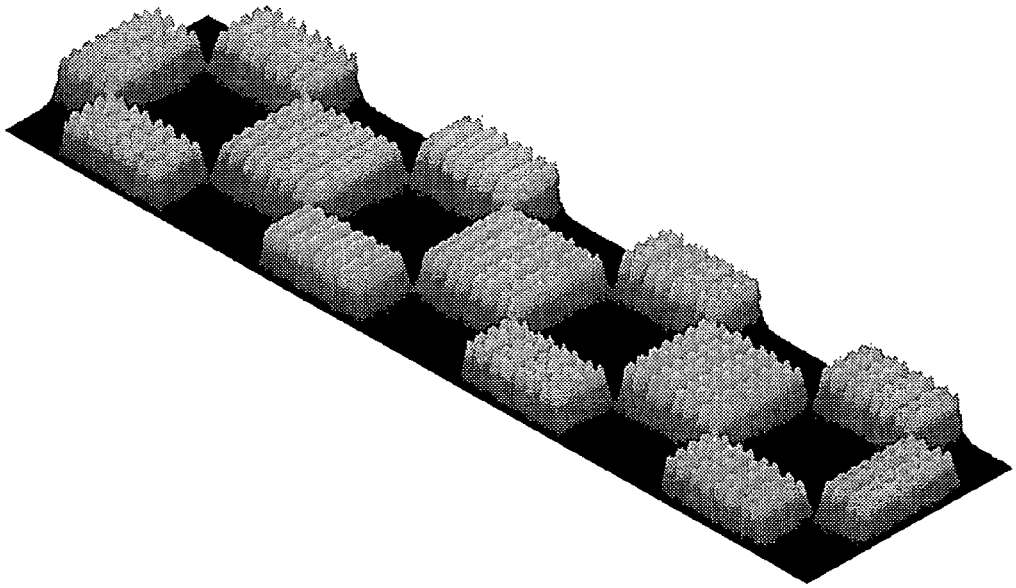
FIG. 11 is a graphical representation of a 2D exposure intensity distribution corresponding to a virtual 2D energizing pattern.

Since the two-dimensional exposure intensity distributions are known from the measurements performed in step S22, a virtual two-dimensional exposure intensity distribution corresponding to the pattern of FIG. 10 can be constructed. The distribution corresponding to a line L1 is the one measured while the LEDs were energized according to the scheme of FIG. 5B. The distribution corresponding to a line L2 is the one measured while the LEDs were energized according to the scheme of FIG. 5C. For constructing the virtual two-dimensional exposure intensity distribution, the distributions of the lines L1 and L2 are assembled by a computing means according to the pattern illustrated in FIG. 10. The result of the computation is shown in FIG. 11. The light areas indicate the positions where light is received, while the dark area indicates the absence of received light.

In step S30, a corresponding two-dimensional predicted toner area coverage distribution is computed. This computation is based on the knowledge of a pre-established representative function for the toner area coverage as a function of the exposure intensity. Such a transfer function resembles to the one shown in FIG. 7.

In step S32, the two-dimensional predicted coverage distribution is taken into account for determining the setting values for the energy output levels for driving a number of LEDs. For example, an area C1 (see FIG. 10) is analyzed. For said area C1, the averaged predicted toner area coverage $T_1$ is calculated in step S31. It is compared to a target value $T_0$, and the output energy level $E_0$ is modified such that a setting value $E_1$ for the energy output level for driving the LEDs is determined. The determination of $E_1$ is done in order to achieve the target $T_0$ for the averaged predicted toner area coverage. The procedure is similar to the one illustrated in FIG. 8. For the area C1, a setting value $E_1$ for the energy output level for driving the LEDs is thus determined. In a first approximation, $E_1$ is the setting value for driving each one of the eight LEDs which were turned on in the area C1, i.e. the LEDs with index 42 to 49.

The procedure is repeated for the area C2 (see FIG. 10) which overlaps the area C1 and which has the same surface. Since both areas have the same surface, and the pattern ON/OFF is regular, a same number of LEDs are turned on within each area. In step S32, a setting value $E_2$ for the energy output level can be determined, using the same criterion that a target value $T_0$ should be achieved for the averaged predicted toner area coverage. In a first approximation, $E_2$ is the setting value for driving each one of the eight LEDs which were turned on in the area C2, i.e. the LEDs with index 46 to 53.

Since the areas C1 and C2 overlap, for the common LEDs (i.e. the LEDs with indexes 46 to 49) two energy levels have been determined: $E_1$ and $E_2$. It is a good approximation to assume that the setting value for the energy output level for these four common LEDs is the average value of $E_1$ and $E_2$. The averaging operation is carried out in step S34. A setting value for the energy output level for driving each individual LED is thus determined.

The procedure is repeated over the whole length of the virtual light image shown in FIG. 10. The setting values E are transmitted in step S36 to the exposure device 19 for storage on the non-volatile memory 25 in the form of a look-up table.

Alternately, by means of a function fitting the setting values E as a function of the x-position of the LED, a different energy level can be determined for each one of the N LEDs of the row 32. The energy levels are stored on the look-up table in the non-volatile memory 25 of the exposure device 19.

The steps of the method of the present invention may be carried out by an apparatus 70 shown in FIG. 12 for determining the setting values for the energy output levels for driving the LEDs of an exposure device 19, the exposure device being arranged according to FIG. 13. The apparatus 70 comprises a Central Processing Unit (CPU) 72, a Random Access Memory (RAM) 74, data storage device such as a hard disk (HD) 76, a selection and energizing module 82, an adjusting module 80 and a measuring module 84. The aforementioned units are interconnected through a bus system 78. When the method is carried out, the apparatus 70 is connected to the exposure device 19 and to the photosensor 86, by means of a connection unit (not shown)

The CPU 72 controls the respective units of the apparatus 70 in accordance with control programs stored on the hard disk 76, such as computer programs required to execute processes shown in the flowcharts described above.

The hard disk 76 is an example of a storage device that stores digital data, such as the pre-determined representative function 37 and the representative function 38. The data stored on the hard disk 76 is read out onto the RAM 74 by the CPU 72 as needed. Once the setting values E have been determined and stored on the apparatus 70, the setting values E are read out from the RAM 74 or from the hard disk 76 by the CPU and are written onto the non-volatile memory 25 suited for storing the list (look-up table) comprising the setting values for the energy output level for driving each individual LED.

The RAM 74 has an area for temporarily storing programs and data, which is read out from the memory device 76 by the CPU 72, and also a work area which is used by the CPU 72 to execute various processes.

The selection and energizing module 82, the adjusting module 80 and the measuring module 84 may be implemented either as a software component of an operating system running on the apparatus 70 or as a firmware program executed on the CPU 72.

The selection and energizing module 82 is suitable to execute, in cooperation with the CPU 72, the steps S1, S2, S12, S14, S19, S20, S24, S26 described above. For executing the step of energizing the selected LEDs (S2, S20), the module 82 outputs appropriate electric signals to the drivers 24 of the exposure device, through a known communication device.

The measuring module 84 ensures, in cooperation with the photosensor 86 and the CPU 72, that exposure intensity distributions are measured, and the data stored on the RAM 74 or on the hard disk 76. The module 84 is suitable for executing the steps S4 and S22.

The adjusting module 80 is suitable for executing, in cooperation with the CPU 72 and the memory device, the steps S6, S7, S8, S10, S28, S30, S31, S32, S34 and S36. The data corresponding to the setting values are passed to the non-volatile memory 25 by a known communication device.

In the present example, the exposure device 19 comprises a single row of LEDs comprising N LEDs. However, the present invention is also well-suited for determining the setting values for the energy output levels for driving light-emitting elements of an exposure device having light-emitting elements arranged in a different way, for example according to several parallel rows.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of reducing unevenness in optical density of an exposure device suited for an electrophotographic printer, said exposure device comprising a plurality of light-emitting elements arranged in a row, said method comprising the steps of:

energizing selected light-emitting elements according to a selection scheme, the selected light-emitting elements being a plural number of the plurality of light-emitting elements arranged in a row;

using a pre-determined energy level for energizing each selected light-emitting element and measuring a corresponding exposure intensity distribution of the energized plural number of the plurality of light-emitting elements arranged in a row from the exposure device;

predicting a toner area coverage distribution on a medium, based on the measured exposure intensity distribution of the energized plural number of the plurality of light emitting elements arranged in a row and on a pre-established transfer function; and obtaining an average of the predicted toner area coverage distribution on the medium of the energized plural number of the plurality of light-emitting elements arranged in a row; and determining setting values for the energy levels for energizing each selected light-emitting element such that the obtained average becomes a target attribute.

2. The method of adjusting an exposure device according to claim 1, wherein the obtained average of the predicted toner area coverage distribution is a locally averaged value of the predicted toner area coverage distribution.

3. The method of adjusting an exposure device according to claim 1, wherein the setting values for the energy levels for energizing each light-emitting element are current values to be applied by drivers to the light-emitting elements of the exposure device.

4. The method of adjusting an exposure device according to claim 2, wherein the setting values for the energy levels for energizing each light-emitting element are current values to be applied by drivers to the light-emitting elements of the exposure device.

5. The method of adjusting an exposure device according to claim 1, wherein the pre-established transfer function represents a typical variation of the toner area coverage obtained on a print medium as a function of the received light intensity for the type of process used by the printing apparatus for which the adjustment is performed.

6. The method of adjusting an exposure device according to claim 2, wherein the pre-established transfer function represents a typical variation of the toner area coverage obtained on a print medium as a function of the received light intensity for the type of process used by the printing apparatus for which the adjustment is performed.

7. The method of adjusting an exposure device according to claim 3, wherein the pre-established transfer function represents a typical variation of the toner area coverage obtained on a print medium as a function of the received light intensity for the type of process used by the printing apparatus for which the adjustment is performed.

8. The method of adjusting an exposure device according to claim 4, wherein the pre-established transfer function represents a typical variation of the toner area coverage obtained on a print medium as a function of the received light intensity for the type of process used by the printing apparatus for which the adjustment is performed.

9. The method of adjusting an exposure device according to claim 1, further comprising the step of storing the setting values for the energy levels for energizing each light-emitting element on a non-volatile memory device of the exposure device.

10. The method of adjusting an exposure device according to claim 2, further comprising the step of storing the setting values for the energy levels for energizing each light-emitting element on a non-volatile memory device of the exposure device.

11. An apparatus for reducing unevenness in optical density of an exposure device suited for an electrophotographic printer, said exposure device comprising a plurality of light-emitting elements arranged in a row, said apparatus comprising:

a selection and energizing module that energizes plural selected light-emitting elements arranged in the row according to a selection scheme, the selected light-emitting elements being a plural number of the plurality of light-emitting elements arranged in a row, using a pre-determined energy level for energizing each selected light-emitting element;

a measuring module that measures a corresponding exposure intensity distribution of the energized plural number of the plurality of light-emitting elements in the row from the exposure device; and an adjusting module that predicts a toner area coverage distribution on a medium, based on the obtained exposure intensity distribution of the energized plural number of the plurality of light-emitting elements arranged in a row and on a pre-established transfer function, to obtain an average of the predicted toner area coverage distribution on the medium of the energized plural number of the plurality of light-emitting elements arranged in a row and to determine setting values for the energy levels to energize each selected light-emitting element such that the obtained average becomes a target attribute.

12. A method of reducing unevenness in optical density of an exposure device suited for an electrophotographic printer, said exposure device comprising a plurality of light-emitting elements arranged in a row, said method comprising the steps of:

using a selection and energizing module to energize selected light-emitting elements according to a selection scheme, the selected light-emitting elements being a plural number of the plurality of light-emitting elements arranged in a row, using a pre-determined energy level for energizing each selected light-emitting element;

using a measuring module to measure a corresponding exposure intensity distribution of the energized plural number of the plurality of light-emitting elements in the row from the exposure device;

using an adjusting module to predict a toner area coverage distribution on a medium, based on the obtained exposure intensity distribution of the energized plural number of the plurality of light-emitting elements arranged in a row and on a pre-established transfer function to obtain an average of the predicted toner area coverage distribution on the medium of the energized plural number of the plurality of light-emitting elements arranged in a row and to determine setting values for the energy levels to energize each selected light-emitting element such that the obtained average becomes a target attribute.

13. The method of adjusting an exposure device according to claim 12, wherein the obtained average of the predicted toner area coverage distribution is a locally averaged value of the predicted toner area coverage distribution.

14. The method of adjusting an exposure device according to claim 12, wherein the setting values for the energy levels for energizing each light-emitting element are current values to be applied by drivers to the light-emitting elements of the exposure device.

15. The method of adjusting an exposure device according to claim 13, wherein the setting values for the energy levels for energizing each light-emitting element are current values to be applied by drivers to the light-emitting elements of the exposure device.

16. The method of adjusting an exposure device according to claim 12, wherein the pre-established transfer function represents a typical variation of the toner area coverage obtained on a print medium as a function of the received light intensity for the type of process used by the printing apparatus for which the adjustment is performed.

17. The method of adjusting an exposure device according to claim 13, wherein the pre-established transfer function represents a typical variation of the toner area coverage obtained on a print medium as a function of the received light intensity for the type of process used by the printing apparatus for which the adjustment is performed.

18. The method of adjusting an exposure device according to claim 14, wherein the pre-established transfer function represents a typical variation of the toner area coverage obtained on a print medium as a function of the received light intensity for the type of process used by the printing apparatus for which the adjustment is performed.

19. The method of adjusting an exposure device according to claim 15, wherein the pre-established transfer function represents a typical variation of the toner area coverage obtained on a print medium as a function of the received light intensity for the type of process used by the printing apparatus for which the adjustment is performed.

20. The method of adjusting an exposure device according to claim 12, further comprising the step of storing the setting values for the energy levels for energizing each light-emitting element on a non-volatile memory device of the exposure device.

21. The method of adjusting an exposure device according to claim 13, further comprising the step of storing the setting values for the energy levels for energizing each light-emitting element on a non-volatile memory device of the exposure device.

22. A method of minimizing unevenness of optical density of images printed with an electrophotographic printer in which image exposure is achieved using an array of light emitting diodes (LEDs), comprising:

energizing a selected plural number of light-emitting diodes in the array according to a selection scheme, the selected light-emitting diodes being a plural number of the light-emitting diodes arranged in a row in the array of light-emitting diodes;

using a same pre-determined energy level for energizing each selected light-emitting element and measuring a corresponding exposure intensity distribution of the energized plural number of light emitting diodes arranged in a row in the array of light-emitting diodes from the exposure device;

predicting a toner area coverage distribution of a printed image, based on the obtained exposure intensity distribution of the energized plural number of light emitting diodes arranged in a row in the array of light-emitting diodes and on a pre-established transfer function; and obtaining an average of the predicted toner area coverage distribution on the printed image of the energized plural number of light emitting diodes arranged in a row in the array of light-emitting diodes and determining setting values for the energy levels for energizing each selected light-emitting element such that the obtained average becomes a target attribute, wherein the setting values depend on the target attribute of the predicted toner area coverage distribution of the printed image.

* * * * *